United States Patent [19]

Denise

[11] 4,277,896

[45] Jul. 14, 1981

[54] MECHANISM FOR CONTROLLING THE DISPLACEMENT OF A STRAIGHT EDGE ON A DRAWING BOARD

[76] Inventor: Pierre Denise, 6 Rue de la Vallée, Saint-Nicolas D'Acy, 60302 Senlis, France

[21] Appl. No.: 75,535

[22] Filed: Sep. 13, 1979

[30] Foreign Application Priority Data

Sep. 19, 1978 [FR] France ..... 78 26807
Aug. 21, 1979 [FR] France ..... 79 21053

[51] Int. Cl.[3] ..... B43L 13/02
[52] U.S. Cl. ..... 33/443
[58] Field of Search ..... 33/443, 444, 445

[56] References Cited

U.S. PATENT DOCUMENTS

| | | | |
|---|---|---|---|
| 475,741 | 5/1892 | Page | 33/444 |
| 2,160,130 | 5/1939 | De lisle | 33/443 |
| 2,399,610 | 4/1946 | West et al. | 33/443 X |
| 3,082,535 | 3/1963 | Cardinell | 33/444 |

*Primary Examiner*—Harry N. Haroian
*Attorney, Agent, or Firm*—Cushman, Darby & Cushman

[57] ABSTRACT

Fixed on the board (1) is a support (8) in which is rotatably mounted a shaft (7) which is rigid with two pulleys (5*a*, 5*b*) each cooperating with guide means (3*a*, 3*b*) respectively for the straight-edge. Mounted between the support (8) and the shaft (7) are a rotary sleeve (14) and a spring which is wound around the shaft (7) and is rigid (at 19) with the shaft and (at 17) with the sleeve (14) in the support (12) but is withdrawable so as to permit the regulation of the torsion of the spring (18) and the balancing of the straight-edge.

19 Claims, 9 Drawing Figures

MECHANISM FOR CONTROLLING THE DISPLACEMENT OF A STRAIGHT EDGE ON A DRAWING BOARD

DESCRIPTION

The present invention relates to a mechanism for controlling the displacement of a straight-edge, while maintaining the latter parallel to itself, on a drawing board or the like, of the type comprising at least two rollers or pulleys which are connected to rotate with a shaft which is disposed to be parallel to the straight-edge and, on two opposite sides of the board, guide means of the cable or toothed belt type each of which cooperates respectively with one of the rollers or pulleys, and one of the elements comprising the straight-edge and the board being connected to move in translation with the pulleys and the other of said elements being connected to move in translation with the guide means.

The cooperation of the pulleys with the guide means ensures a synchronization between the displacements of the two ends of the straight-edge and thus maintains this straight-edge parallel to itself in all its positions. However, it is necessary to arrange that the straight-edge be capable of being immobilized at a chosen point irrespective of the inclination of the drawing board.

When the guide means is constituted by a cable or an endless belt, connected to one end of the straight-edge, usually a counterweight is mounted on the lower portion of the guide means. Unfortunately, this counterweight is relatively space-consuming and moreover does not ensure an effective balancing in all the positions of the straight-edge and of the drawing board.

It is also known to employ springs which retain the straight-edge and prevent the dropping of the straight-edge under, for example, the force of gravity, but each displacement of the straight-edge or each modification in the inclination of the board results in a modification of the force required to maintain the straight-edge in the chosen position, so that the springs provide an effective maintenance only in some of these positions and in the other positions the straight-edge must be held by the hand.

U.S. Pat. No. 3,082,535 provides a partial solution to this problem. It discloses a mechanism for balancing a straight-edge which comprises a helical spring which is wound around a shaft and fixed to the latter at one end and to a fixed support at its other end. This shaft carries a pulley on which is wound a first cable to which one end of the straight-edge is hooked. The pulley is rendered rotatable with the shaft by a releasable coupling. Moreover, the two ends of the straight-edge are fixed to a second cable which is independent of the first cable and ensures in the conventional manner the synchronization of the displacements of the two ends of the straight edge. In order to regulate the balancing of the straight-edge, the pulley is uncoupled from the shaft and the shaft is rotated by means of a knurled knob so as to modify the tension of the spring.

However, this arrangement has the drawback of requiring a balancing device which is distinct from the mechanism controlling the displacement of the straight-edge while maintaining the latter parallel to itself so that the overall size and the cost of the assembly are increased. Furthermore, this balancing device could not be adapted to the control mechanism of the aforementioned type by mounting the spring directly on the shaft of this mechanism, and rendering one of its pulleys releasable. Indeed, in this case, the rotation of the shaft would cause the rotation of the other pulley and therefore of the corresponding end of the straight-edge so that any modification in the tension of the spring would result in a change in the angular position of the straight-edge on the cable.

An object of the invention is therefore to provide a control mechanism of the aforementioned type which comprises, connected with this mechanism, a device for balancing the straight-edge which permits regulating the balancing without modifying the orientation of the straight-edge on the board.

Another object of the invention is to provide a control mechanism of the aforementioned type which easily permits the selective modification of the orientation of the straight-edge on the drawing board without changing the regulation of the balancing, and a locking of the straight-edge in any position of the latter on the board, and which, in the case of endless guide means, permits a regulation of the tension.

According to the invention, there is provided a mechanism for controlling the displacement of a straight-edge, while maintaining the latter parallel to itself, on a drawing board, this mechanism comprising a rotary shaft carrying at each of its ends a pulley and disposed to be parallel to the straight-edge, two guide means mounted along two opposite sides of the board and each cooperating with a pulley, the straight-edge and the board being connected to move in translation one with the pulleys and the other with the guide means, and a device for balancing the straight-edge and comprising a torsion spring which is wound around the shaft and has a first end connected to rotate with the shaft and an opposite end which is normally prevented from rotating relative to said shaft, and means for regulating the tension of the spring, the means for regulating the tension of the spring comprising a sleeve which is interposed between the shaft and a fixed support and to which support is fixed said opposite end of the spring, the sleeve and the shaft on one hand and the sleeve and the support on the other hand being capable of rotating with respect to each other, and withdrawable means for rendering the sleeve rigid with the support.

In one embodiment of the invention, the sleeve comprises a hollow knurled head which is fitted on a flange rigid with the fixed support and locked on this flange by said withdrawable connecting means.

In another embodiment, said withdrawable connecting means comprise a lock member which is movable between a first position in which it renders the sleeve rigid with a flange which is rigid with this fixed support and a second position in which it locks the sleeve with one of said pulleys as concerns rotation.

According to another feature of the invention, the balancing device being associated with one of said pulleys, the control mechanism comprises a device for braking the straight-edge and associated with the other pulley, said braking device comprising a member rigid with the fixed support and carrying at least one brake jaw, a skirt rigid with said other pulley and surrounding said jaw, and means for selectively clamping said jaw against said skirt.

According to another feature of the invention, the support of the rotary shaft and of the pulleys is fixed to the board along a longitudinal edge of the latter and the guide means are formed by endless elements each of which passes around a second pulley disposed in the vicinity of the other longitudinal edge of the board, and said second pulleys are each associated with a device for regulating the tension of the spring and comprising a shaft which carries said second pulley and is mounted in an oblong bore of a support unit which is fixed along said other longitudinal edge of the board, said bore being elongated in a plane parallel to the plane of the board, the regulating device also comprising means for regulating the position of the shaft in the bore.

Further features and advantages of the invention will be apparent from the ensuing description of embodiments thereof illustrated in the accompanying drawings, in which.

Figure 1:
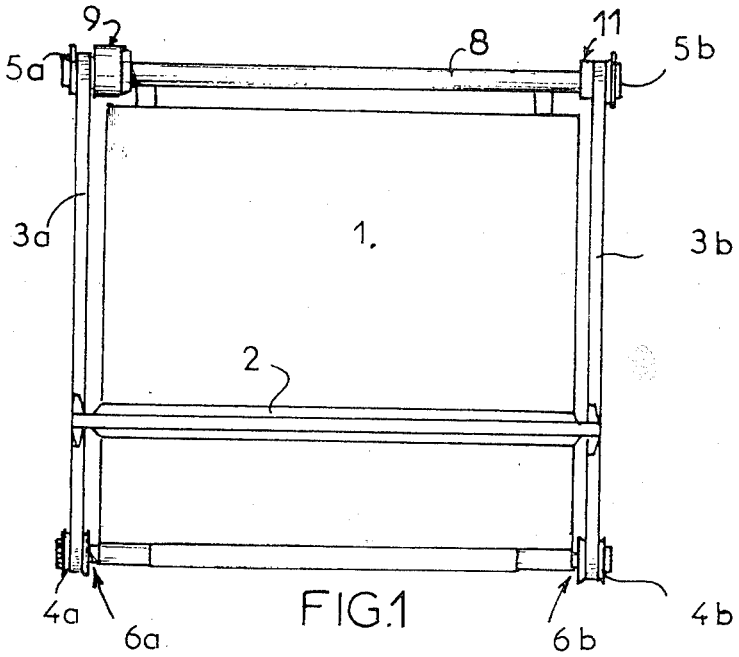
FIG. 1 is a diagrammatic plan view of a mechanism controlling the displacement of a straight-edge in a direction parallel to itself, on a drawing board according to the invention.

FIG. 1 shows a drawing board or table 1 on which is mounted a straight-edge 2 which is capable of moving while remaining parallel to itself over the entire area of the board 1. For this purpose, the board or table 1 is provided with a control mechanism which comprises two guide means 3*a* and 3*b* which are elongated and mounted on each side of the board and parallel to the lateral sides of the latter. In the illustrated embodiment, each of the guide means is an endless element constituted at least partly by a non extensible toothed belt which passes around two pulleys 4*a*, 5*a* and 4*b*, 5*b* respectively. The lower pulleys 4*a*, 4*b* of the two guide elements 3*a*, 3*b* are mounted to be freely rotatable on a shaft which is part of a device 6*a*, 6*b* for regulating the tension of the belt and rigid with the board 1. The upper pulleys 5*a*, 5*b*, which are toothed, are connected to rotate with each other and are mounted at the two ends on a shaft 7 (FIG. 2) which is free to rotate inside a tubular support 8, which is parallel to the upper edge of the board 1. The upper pulley 5*a* around which the belt 3 passes, is associated with a device for balancing and regulating the orientation of the straight-edge 2 and the upper pulley 5*b* around which the other belt 3*b* passes is associated with a device 11 for braking the straight-edge 2.

The support 8 is mounted on the board 1 so as to be rigid therewith and the straight-edge 2 is connected at its two ends to the guide means 3*a*, 3*b* and moves in translation with the latter. Any displacement of the straight-edge 2 along the board 1 consequently results in a simultaneous displacement in translation of the two guide means 3*a*, 3*b*, that is to say a simultaneous rotation of the two toothed pulleys 5*a*, 5*b* and the shaft.

Figure 2:
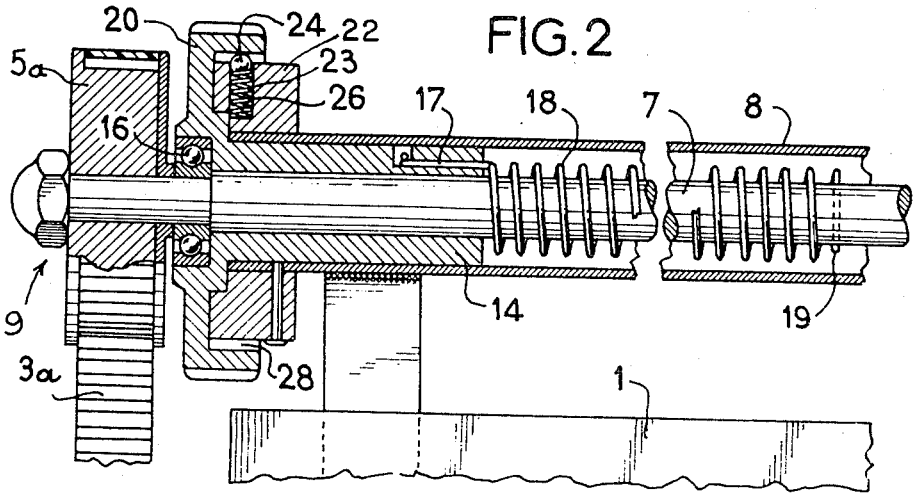
FIG. 2 is an axial sectional view, to an enlarged scale, of a device for balancing the straight-edge.

Reference will now be made to FIG. 2 which shows a first embodiment of the balancing device 9. As shown in this FIG. 2, there is mounted between the shaft 7 and its support 8 on the side adjacent the pulley 5*a* a sleeve 14 which is freely rotatable relative to the shaft 7 owing to the interposition of a ball bearing 16 and which moreover is freely rotatable in the support 8. Fixed in the sleeve 14 is the end 17 of a torsion spring 18 which is wound around the shaft 7 and has its opposite end 19 fixed to this shaft 7. The outer end of the sleeve 14 is moreover provided with a knurled head 20 which projects out of the support 8 and is hollowed out and fitted on a flange 22 rigid with the support 8.

The flange 22 has a radial recess 23 in which is mounted a ball 24 which is biased outwardly by a spring 26. This ball cooperates with notches formed in the inner surface of the hollow 28 of the head 20 so as to interconnect the flange 22 and the head 20 of the sleeve 14 so that they rotate together. However, the notches are defined by curved surfaces so that a force exerted on the knurled head 20 permits a rotation of the latter relative to the flange 22 and a modification of the position of the sleeve 14 inside the support tube 8 relative to the shaft 7. It is clear that by so rotating the sleeve 14 the torsion of the spring 18 can be modified.

When displacing the straight-edge 2 to the chosen position the rotation of the toothed pulleys 5*a*, 5*b* causes the rotation of the shaft 7 but does not drive the sleeve 14 which is rigid with the flange 22. Consequently, the torsion of the spring 18 is modified by the displacement of the straight-edge 2. On the other hand, when the straight-edge is stationary, a rotation of the knurled head 20 against the action of the ball 24 turns the sleeve 14 about the shaft 7 and regulates the torsion of the spring 18. This rotation may be indeed effected in the appropriate direction and may correspond to a given angular displacement as soon as the knurled head 20 is released, the ball 24 locks again this head on the flange 22 and immobilizes the sleeve 14.

Thus it is possible for the user to balance the straight-edge 2 in any position irrespective of the inclination of the board or table 1 and to be sure that the straight-edge will remain strictly in the same position during the desired period of time.

Figure 3:
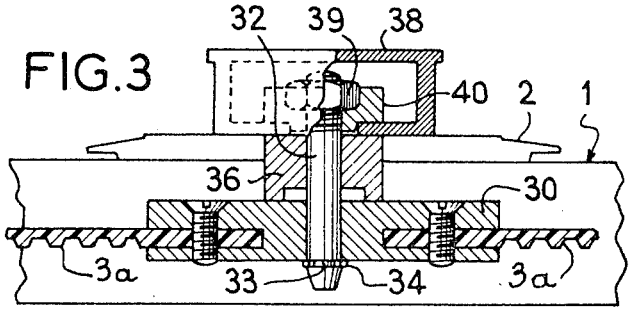
FIG. 3 is a sectional view taken on line 3—3 of FIG. 1 to an enlarged scale.

Of course, the same balancing device may be mounted in a control mechanism employing a cable, the toothed pulleys being then replaced by ordinary pulleys or by threaded rollers. The ends of a cable or of a toothed belt constitute an endless guide means and are preferably fixed to each other by means of a junction plate 30 (FIG. 3) which is provided with a centre aperture in which a pin 32 rigid with the straight-edge 2 is fitted. The pin 32 has an end comprising an annular groove in which there is mounted an O-ring for example of rubber 34 which is sufficiently elastic to be withdrawn within the groove 33 and may be easily pushed into the plate 30 or withdrawn therefrom when it is desired to separate the straight-edge 2 from the guide means 3*a*.

Preferably, the pin 32 is carried by a fixing block 36 in abutment against the end of the straight-edge 2. Beyond this block 36, the pin 32 extends inside a U-section member 38 and has a screwthreaded end portion on which there is screwed a nut 39 which clamps a slide 40 against the formed-over flanges of the U-section member. The assembly comprising the fixing block, the slide and the pin 32 is thus closely rigid with the straight-edge 2 and this assembly may be separated from the junction plate 30 by withdrawing the pin 32 from the aperture of the latter. At this moment, the straight edge is released and may be raised off the drawing board, for example for placing a sheet in position or for any other reason. The pin 32 is then easily re-introduced into the plate 30, the ring 34 elastically emerging from the groove 33 and locking the assembly.

Figure 3A:
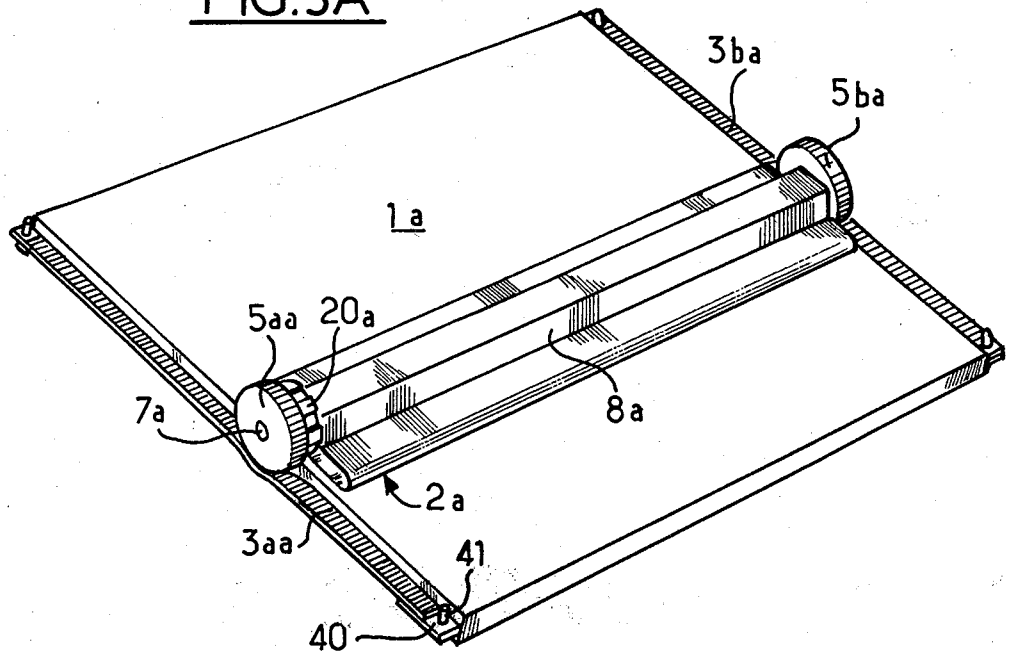
FIG. 3A is a perspective view of another embodiment of the invention.

In the mechanism controlling the displacement of the straight-edge shown in the drawings, and which has just been described, the support 8 of the rotary shaft 7 and of the pulleys 5*a*, 5*b* is fixed to the drawing board 1, whereas the guide means are rigid in translation with the straight-edge 2, but it will be understood that the balancing device of the invention may also be mounted on a mechanism which operates in the opposite manner, that is to say in which the pulleys and the rotary shaft interconnecting them are connected to be movable in translation with the straight-edge 2, whereas the guide means are rigid with the board 1. For example, as shown in FIG. 3A, in which elements similar to those in the previously-described embodiment carry the same reference numerals to which a letter a has been added, the sleeve 14 may be held stationary inside the support member 8*a* and interposed between the latter and the rotary shaft 7*a* mounted inside the U-section member 38 support member 8*a* which is U-sectioned and rigid with the straight-edge 2*a*, the knurled head 20*a* projecting at one of the ends of this U-section member 8*a* between the latter and the corresponding toothed pulley 5*aa* which latter and corresponding pulley 5*ba* at the opposite end of the shaft 7*a* are respectively engaged with the guide means 3*an* and 3*ba* rigid with the board 1*a*. As explained before, the spring 18 would be fixed at one end to the sleeve 14 and at the opposite end to the shaft 7*a*. The straight-edge may then be immobilized in any desired position as described before.

Each guide means may be a toothed belt may, of course, be fixed at each of its ends to a plate 40 provided with an aperture for co-operation with a fixing pin 41, but in this case, the pin is rigid with the board 1*a*. As in the previously described embodiment, this arrangement facilitates the possible replacement of the belt or cable and permits putting the guide means under tension. Indeed, it is no longer necessary to provide a clearance allowing a raising of the straight-edge since the latter may be rendered independent of either of the guide means as desired. The precision of the synchronization of the displacements of the two ends of the straight-edge is consequently enhanced.

Figure 4:
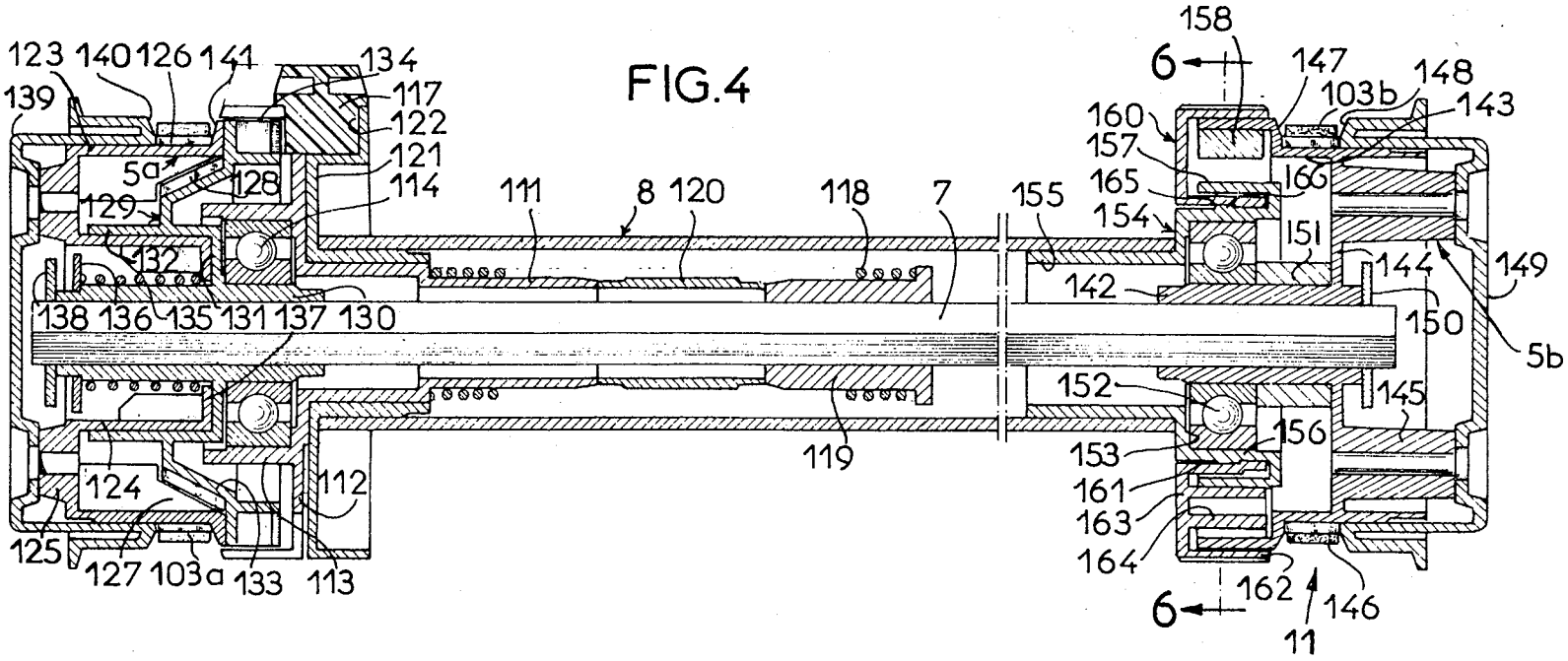
FIG. 4 is a view similar to FIG. 2 of a modification of the balancing device and also showing a device for regulating the orientation of the straight-edge and a device for braking the straight-edge.
Figure 5:
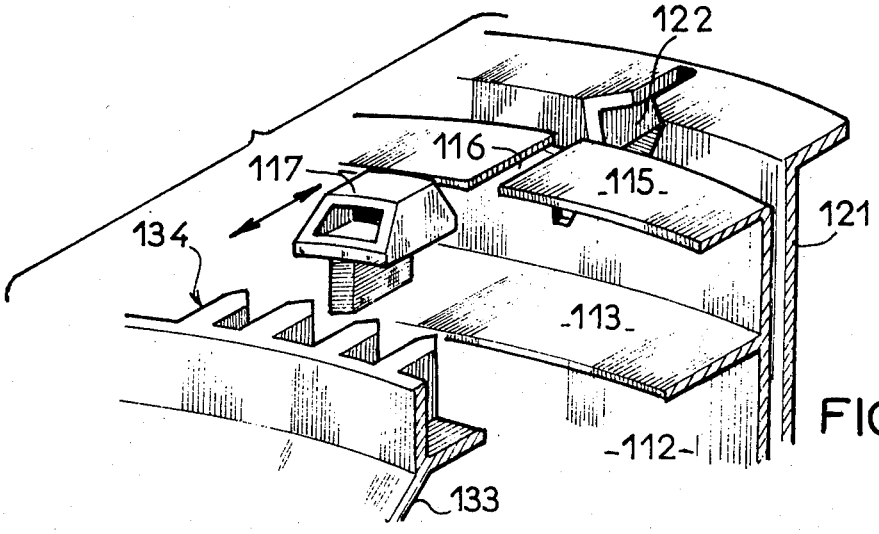
FIG. 5 is a perspective view, to an enlarged scale, of a detail of the balancing device and of the regulation of the orientation of the straight-edge shown in FIG. 4.

Reference will now be made to FIGS. 4 and 5 which illustrate a second embodiment of the balancing device which is designated by the reference numeral 109 and may be substituted for the balancing device 9 of FIG. 2. In this embodiment, the shaft 7 has a polygonal section and a cylindrical sleeve 111 having a diameter exceeding the largest dimension in section of the shaft 7 is rotatively mounted on the latter. The sleeve 111 is rigid at one of its ends with a radial flange 112 which has on one face thereof a cylindrical extension 113 defining with the flange 112 a recess in which a ball bearing 114 is received. The flange 112 terminates on its periphery in a ring 115 disposed on the same side of the flange 112 as the extension 113, that is to say on the side opposed to the fixed support 8. Formed in the ring 115 and the flange 112 is a slot 116 through which is movable a lock member 117 whose function will be explained hereinafter.

On the other end of the sleeve 111 which extends inside the tubular support 8 there is fitted a torsion coil spring 118. The other end of the spring 118 is fitted on a ring 119 which is freely slidably mounted on the shaft 7. The section of the inner orifice of the ring 119 is complementary to that of the shaft 7 so that it rotates with the latter. The ends of the spring 118 are connected to rotate together with the sleeve 111 and the ring 119 respectively owing to the tightening of a few coils on these two ends, and the end of the spring fixed to the ring 119 is free to move axially with the ring along the shaft 7. Further, in order to prevent the spring from deforming between the ends thereof, a tubular spacer member 120 is disposed around the shaft 7 between the sleeve 111 and the ring 119.

The sleeve 111 is fitted in a flange 121 which is rigid with the fixed support 8 and ensures its axial and radial positioning. The flange 121 has on its periphery one or preferably a plurality of cavities 122 which are open on the side adjacent the flange 112 and closed on the opposite side and with which the slot 116 may be aligned in a direction parallel to the shaft 107.

In the position of alignment of the slot 116 with a cavity 122 the latter is capable of receiving the lock member 117. The length of the lock member is such that when it is fully engaged in the cavity 122 it partly extends into the slot 116 and thereby locks the flange 112 with the flange 121 so as to prevent the rotation of the sleeve 111 relative to the support 8.

The toothed pulley 5*a* is constituted by a tubular member having a cylindrical outer skirt 123 and an inner cylindrical skirt 124 connected by an annular web 125. The outer skirt 123 carries on its outer face radial teeth 126 which cooperate with the toothed belt 3*a* and on its inner surface conical teeth 127. The teeth 127 cooperate with complementary conical teeth 128 carried by an intermediate member 129. The intermediate member 129 comprises a tubular portion 130 having a cylindrical outer surface and whose inner section is complementary to that of the shaft 7 so that the member 129 rotates with the shaft 7. The tubular portion 130 is connected by an annular portion 131 which bears against the inner cage of the bearing 114 having a cylindrical skirt 132 which defines with the tubular portion 130 a cavity which is open on the side of the adjacent end of the shaft 7 and in which there is received the inner cylindrical skirt 124 of the pulley 5*a*. The skirt 132 is rigid with a conical portion 133 which carries on one hand the conical teeth 128 and, on the other hand, on its periphery, annular teeth 134 which are engaged under the ring 115 of the flange 112. The gaps between two adjacent teeth of the teeth 134 may be radially aligned with the slot 116 for receiving the lock member 117.

When the lock is fully engaged in the teeth 134, it extends partly in the notch 116 and thereby locks against rotation the intermediate member 129 and consequently the pulley 5*a* through the medium of conical teeth 127 and 128 with the collar 112. It will be observed that the axial length of the lock member 117 is such that, when it is fully engaged in the cavity 122, it is fully disengaged from the teeth 134 and that, inversely, when it is fully engaged in the teeth 134 it is fully disengaged from the recess 122.

The pulley 5*a* is applied against the intermediate member 129 by a coil spring 135 which is disposed around the tubular portion 130 and bears respectively against the circlip 136 fixed to the tubular portion 130 and against an annular flange 137 of the skirt 124. The intermediate member 129 is axially positioned on the shaft 7 between the bearing 114 and a second circlip 138 which is fixed to the shaft 7.

The balancing device 109 is completed by a covering 139 in the form of a cup which is engaged on the outer skirt 123 of the pulley 5*a* and has a conical end flange which defines one of the sides 140 of the pulley, the other side 141 being constituted by a conical flange of the skirt 123. The covering 139 may be fixed to the pulley 5*a* by any suitable means, for example by screws engaged in apertures formed for this purpose, in the covering 139 and in the annular web 125 of the pulley 5*a*.

The balancing device which has just been described permits regulating the tension of the spring 118 for balancing the straight-edge 2 in accordance with the inclination of the board 1 with respect to the vertical. In order that the spring produce the desired balancing effect, the lock member 117 must be located in the position shown in full lines in FIG. 4, that is to say must be fully engaged in the recess 122. Indeed, the spring 118, one end of which is rendered rigid with the fixed support 8 through the medium of the sleeve 111, the collar 112, the lock member 117 and the flange 122, then exerts on the shaft 7 a torque which opposes that due to the weight of the straight-edge 2 and is transmitted through the belt 3*a* and the pulley 5*a*.

If it is desired to increase the tension of the spring 118, the straight-edge is lowered to the position at the base of the table 1, so as to put the spring under tension. Then, the lock member is pushed into the other position shown in dot-dash lines in FIG. 4, in which it prevents the rotation of the sleeve 111 and the collar 112 with respect to the intermediate member 129 and the top of the table, which does not modify the tension of the spring since its two ends are then connected to rotate with the shaft 7. The lock member is then returned to the preceding position and the straight-edge is again lowered to the position of utilization. If the balance has not yet been reached, the foregoing operations are repeated as many times as necessary.

Of course, if the tension of the spring is desired to be reduced, the inverse operations are carried out, that is to say the straight-edge 2 is raised with the lock member 117 urged toward the right and is lowered with the lock member urged to the left.

The device just described has, with respect to that of FIG. 2, the advantage of permitting a much more rapid regulation of the balancing of the straight-edge, in particular when the inclination of the board is greatly modified. Indeed, in order to ensure the balancing of the straight-edge in all the positions of the board between the vertical and the horizontal and in order to ensure, in a given position of the board, the balancing for roughly all the positions of the straight-edge, the spring must have a wide range of regulation and consequently a large number of coils. This signifies that the modification of the regulation is carried out on a large number of rotations of the shaft 7. Now, it is obvious that it is much more rapid to ensure this large number of rotations by displacing the straight-edge along the board alternately upwardly and downwardly than by rotating the knurled knob by hand.

The device for regulating the orientation of the straight-edge essentially comprises the intermediate member 129 and the pulley 5*a* which is biased by the spring 125 against the member 129. In order to regulate the orientation of the straight-edge, the covering 139 is taken hold of and pulled back in opposition to the action of the spring 135 until the conical teeth 127 of the pulley 5*a* are no longer engaged with the conical teeth 128 of the intermediate member 129. The covering and the pulley 5*a* are then rotated so as to displace the end of the straight-edge fixed to the belt 3*a*, the other end of the straight-edge remaining fixed owing to the fact that the shaft 7 is not driven by this movement. When the straight-edge is in the desired orientation, the covering 139 is released and the pulley 5*a* is put back into engagement with the member 129 by the spring 135. The straight-edge is then ready to move while remaining parallel to this orientation.

This possibility of regulating the orientation of straight-edge is of particular utility in a certain number of operations such as, for example, the drawing of plans of public works comprising a large number of straight lines having a slight slope with respect to the horizontal.

Figure 6:
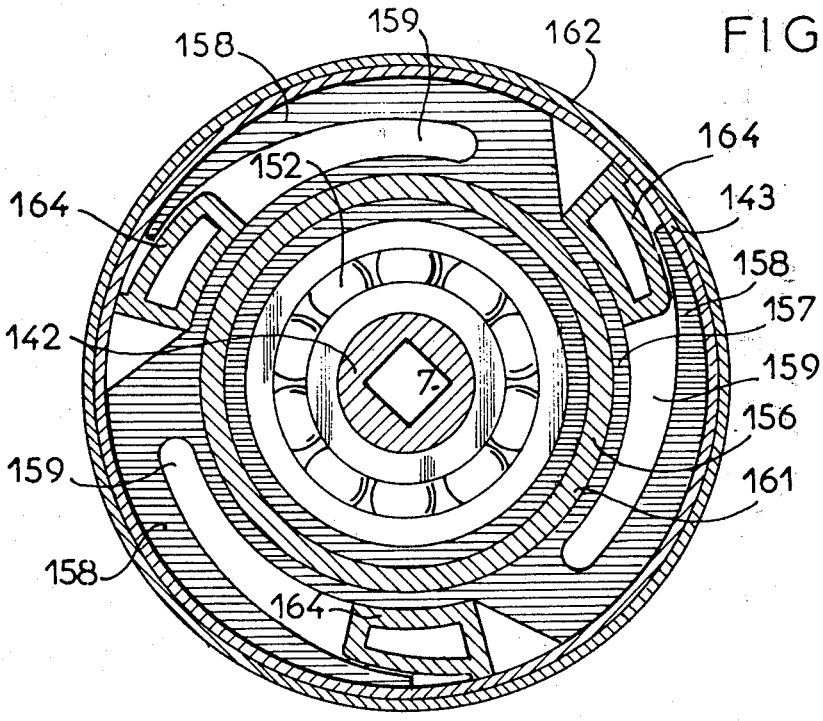
FIG. 6 is a sectional view, taken on line 6—6 of FIG. 4, to an enlarged scale.

Reference will now be made to FIGS. 4 and 6 which show the braking device 11 according to the invention. The pulley 5*b* of this braking device comprises a tubular portion 142 which has a cylindrical outer surface and an inner section which is complementary of the shaft 7 so that the pulley is connected to rotate with the shaft 7. The tubular portion 142 is connected to a coaxial skirt 143 which partly surrounds it by an annular portion 144 which carries axial bosses 145 on the face thereof opposed to the tubular portion 142 and the skirt 143. The skirt 143 carries a set of radial teeth 146 with which the toothed belt 3*b* engages and has a shoulder including a conical portion 147 which constitutes one of the sides of the pulley 5*b*. The other side 148 of the pulley is constituted by a conical end flange of a covering 149 in the form of a cup which is fixed to the pulley 5*b* by screws (not shown) engaged in aligned apertures of the covering 149 and the bosses 145.

The axial position of the pulley 5*b* is determined by a circlip 150 fixed on the shaft 7 and by a tubular spacer member 151 which surrounds the tubular portion 142 and is disposed between the annular portion 144 and the inner ring of a rolling bearing 152 which is also mounted on the tubular portion 142.

The outer ring of the bearing 152 bears against a shoulder 153 of a member 154 which is rigid with the fixed support 8 and forms a brake shoe. This shoulder connects a cylindrical portion 155 fitted in the support 8 to a cylindrical portion 156 which is of larger diameter and in which the bearing 152 is received. The cylindrical portion 156 is rigid with a coaxial cylindrical skirt 157 which surrounds it and carries three circumferential lips 158 constituting the brake shoes proper. Each lip 158 has a cylindrical outer surface and an inner surface which is substantially in the form of a portion of a spiral so as to define with the skirt 157 an elongated slot 159 whose radial dimension progressively decreases from the free end of the lip toward the inner end of the slot where the lips 158 are connected to the skirt 157. The member 154 is made from a plastics material which is capable of imparting a certain flexibility to the lips 158.

The braking device 11 is completed by a control knob 160 including an inner cylindrical skirt 161 and an outer cylindrical skirt 162 which are interconnected by an annular web 163 which carries three wedges 164 which project between the skirt 161 and 162 in the slots 159 and constitute cams which have a profile which is complementary to that of the slots 159. The inner skirt 161 is engaged between the cylindrical portion 156 and the skirt 157 and has internally a peripheral cavity 165 which is clipped on a peripheral boss 166 of the portion 156 so as to axially retain the knob 160. Further, the outer skirt 162 surrounds the skirt 143 of the pulley 105*b* and is knurled externally so as to enable it to be actuated by hand.

In the position shown in FIG. 6 where the knob 160 is turned fully in the direct direction, the wedges 164 are not pushed into the slots 159. The dimensions of the various component parts are such that, in this position, the lips are not clamped against the skirt 143 by the wedges 164 so that the pulley 5*b* is free to rotate with the shaft 7. If it is desired to lock the straight-edge in some position, it is sufficient to rotate the knob in the desired direction, namely in the clockwise direction as viewed in FIG. 6. The wedges 164 are then forced into the slots 159 and clamp the lips 158 which form brake shoes against the skirt 143 of the pulley 105*b*. As the lips 158 form part of the member 154 which is rigid with the fixed support 8, the pulley 5*b* and the pulley 5*a* through the medium of the shaft 7 are thus locked with the fixed support and the straight-edge 2 is immobilized on the table 1.

Figure 7:
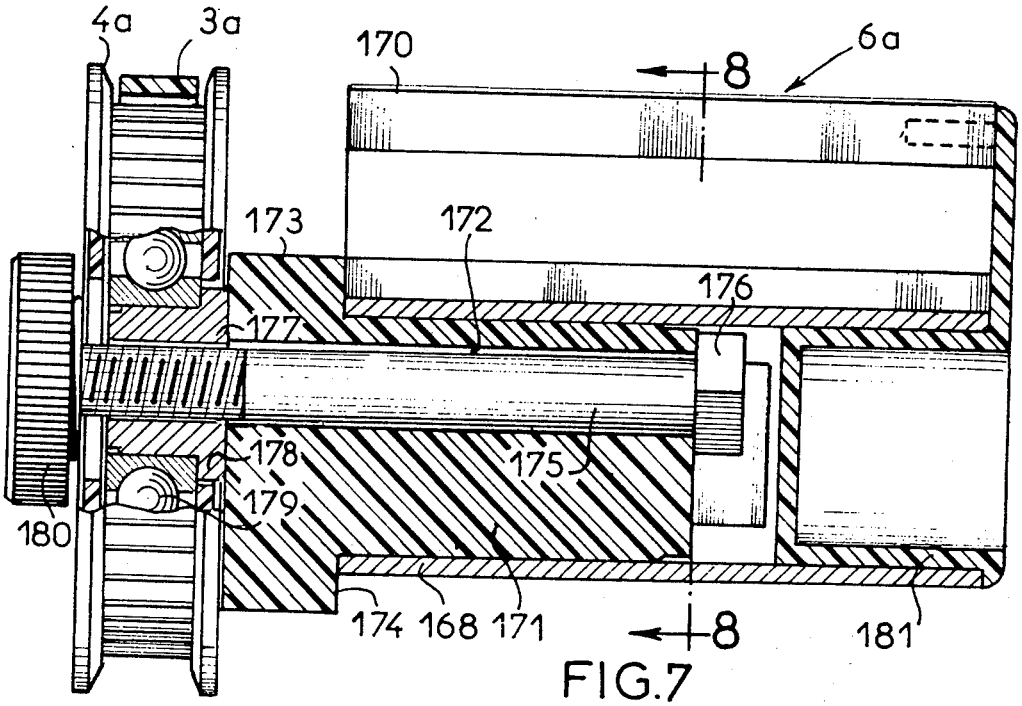
FIG. 7 is an axial sectional view to an enlarged scale of a device for putting the belt under tension.
Figure 8:
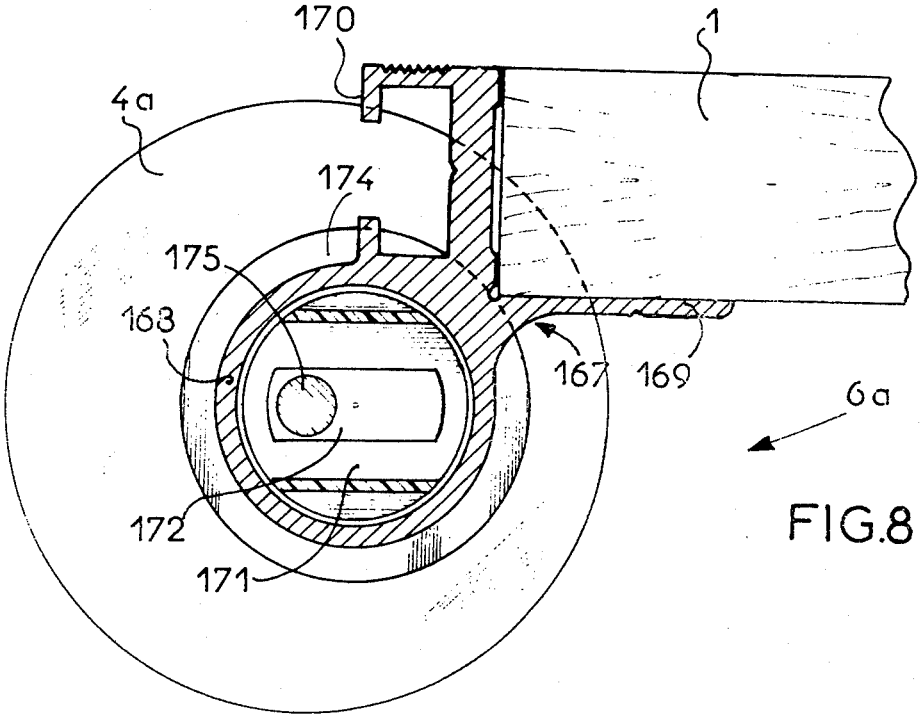
FIG. 8 is a sectional view taken on line 8—8 of FIG. 7.

FIGS. 7 and 8 show one, 6*a*, of the devices for regulating the tension of the belt. Although hereinafter only the device 6*a* is described, it must be understood that this description is also applicable to the device 6*b* which is symmetrical to the device 6*a*.

The device 6*a* comprises a support 167, for example of metal, formed by a tube 168 which is rigid with an L-shaped member having a planar branch 169 and another branch 170 which is constituted by a U-section member. The planar flange 169 is fixed under the board 1 by any suitable means, for example by screws, and the web of the U-section member 170 is fixed against the lower edge of the board by identical or similar means. The support 167 extends along a small part of the width of the board from the left lateral edge of the latter as viewed in FIG. 1.

Fitted in the tube 168 is a cylinder 171 of plastics material which has an oblong axial bore 172 which is elongated in a plane parallel to that of the board 1. The cylinder 171 terminates at one end in a portion 173 of larger diameter defining a shoulder 174 which bears against the end of the support and of the L-shaped member adjacent to the left lateral edge of the table. A shaft 175 extends through the bore 172 and has a screwthreaded end portion which projects out of the portion 173 of the cylinder 171. The shaft 175 is retained in the bore 172 by a head 176 which bears against the end face of the cylinder 171 opposed to the portion 173 of larger diameter.

The pulley 4*a* is mounted on the screwthreaded end portion of the shaft 175 through the medium of a spacer ring 177. This ring has a flange 178 of larger diameter against which bears the inner ring of a ball bearing 179 on which the pulley 4*a* is mounted. The flange is normally maintained in abutment against the confronting end face of the portion 173 of the cylinder 171 by a knob 180 which is screwed on the screwthreaded end portion of the shaft 175 and which clamps the inner ring of the bearing 179 against the flange 178. In this clamped position, the shaft 175 is immobilized in the bore 171 but the axial length of the flange 178 is such that the pulley 4*a* is maintained spaced away from the portion 173 and is capable of rotating freely around the shaft 175.

On the opposite side of the pulley 4*a*, the support 177 is closed by a plug 181 which is received in the open ends of the tube 168 and the section member 170. The part of the plug closing the tube 168 is hollow and permits fitting therein an end portion of a pencil box or other means (not shown in the drawings) the other end of which is received in the plug corresponding to the other device 6*b* for putting the belt 3*b* under tension.

In order to regulate the tension of the belt 3*a*, the knob 180 is loosened and by means of the latter the end of the shaft 175 is displaced until the desired tension is obtained. The knob 180 is then re-tightened so as to immobilize the shaft 175. In order to regulate the tension of the belt 3*b*, the same operations are carried out by means of the device 6*b*.

Note that the fixed support 8 may be formed by a structure member identical to that of the support 167. Owing to the presence of the L-shaped member, the support 8 then has a stiffening effect on the board 1 and the section member 17*o* can be used as a rail for slidably mounting a lamp or other accessory.

It must be understood that the braking device and the device for regulating the tension of the belt described hereinbefore may be associated just as well with the balancing device of FIG. 2 as with that of FIGS. 4 and 5.

I claim:

1. A mechanism in combination with a drawing board which has two opposed sides and for controlling the displacement of a straight-edge while maintaining the straight-edge parallel to itself on the drawing board, said mechanism comprising a rotary shaft, support means for maintaining the shaft parallel to the straight-edge, two pulleys respectively carried by the shaft adjacent opposed ends of the shaft, two guide means respectively mounted alongside the two opposed sides of the board, each guide means being cooperative with a respective one of said pulleys, one of two elements consisting of the straight-edge and the board being connected to move in translation with one of the pulleys and the other of said elements being connected to move in translation with the guide means, a device for balancing the straight-edge and comprising a torsion spring wound around the shaft and having a first end portion which is connected to rotate with said shaft and a second end portion, means for regulating the tension of the spring and comprising a sleeve which is interposed between the shaft and the support means and to which sleeve is fixed said second end portion of the spring, the elements consisting of the sleeve and the shaft and the elements consisting of the sleeve and the support means being relatively rotatable, and withdrawable means for releasably rendering the sleeve rigid with the support means.

2. A mechanism as claimed in claim 1, comprising a flange rigid with the support means, the sleeve comprising a hollow knurled head which is fitted on the flange, and said withdrawable means being operative to lock the knurled head relative to the flange.

3. A mechanism as claimed in claim 2, wherein the hollow knurled head has an inner surface defining a number of notches, a member is carried by the flange and a spring biases the member radially outwardly into one of said notches of the knurled head.

4. A mechanism as claimed in claim 2 or 3, wherein the support means is fixed to the straight-edge, the knurled head being in projecting relation between an edge of the board and the pulley.

5. A mechanism as claimed in claim 1, 2 or 3, wherein the support means is fixed to the drawing board and the guide means are endless and each comprise a flexible member having opposed ends and a plate interconnecting the opposed ends of the member, each plate defines an aperture and a pin withdrawably inserted in the aperture assembles the straight-edge with the corresponding endless guide means.

6. A mechanism as claimed in claim 4, wherein each guide means comprises opposed ends and a plate is connected to each opposed end of each guide means and defines an aperture and pins rigid with the drawing board are respectively inserted in the apertures and fix the corresponding plates to the drawing board.

7. A mechanism as claimed in claim 1, wherein the withdrawable connecting means comprise a flange rigid with the support means, a lock member movable between a first position in which it renders the sleeve rigid with the flange and a second position in which it connects the sleeve to one of the pulleys so that the sleeve rotates with said one of the pulleys.

8. A mechanism as claimed in claim 7, comprising a ring defining an axially extending slot in which slot the lock member is capable of sliding, means defining an annular set of teeth surrounded by the ring, the lock member being capable of engaging said teeth in said second position, said flange having at least one cavity with which cavity the slot is capable of selectively axially aligning and in which cavity the lock member is received in said first position.

9. A mechanism as claimed in claim 8, wherein the annular set of teeth is carried by an intermediate member which is connected to rotate with the shaft and on which intermediate member the correponding pulley is rotatively mounted, the intermediate member and the corresponding pulley comprising releasable complementary coupling means.

10. A mechanism as claimed in claim 9, wherein the complementary coupling means comprise two sets of teeth respectively carried by the corresponding pulley and the intermediate member, the corresponding pulley is axially slidable relative to the intermediate member and elastically yieldable means bias the corresponding pulley against the intermediate member.

11. A mechanism as claimed in any one of the claims 7 to 10, wherein the shaft has a polygonal cross-sectional shape and said first end portion of the spring is fixed to a ring which is slidably mounted on the shaft and has an inner orifice which has a cross-sectional shape complementary to the cross-sectional shape of the shaft.

12. A mechanism as claimed in claim 1, wherein the balancing device is associated with one of the pulleys and comprises a device which is for braking the straight-edge and is associated with the other of the pulleys, the braking device comprising a member rigid with the support means, at least one brake shoe carried by said member, a skirt rigid with said other pulley and surrounding the brake shoe and means for selectively urging the brake shoe against and releasing the brake shoe from the skirt.

13. A mechanism as claimed in claim 12, wherein the brake shoe comprises a circumferential lip connected to a second skirt rigid with said member rigid with the support means, the lip defining with the second skirt an elongated slot having a radial size which progressively decreases from a free end of the lip toward an end of the slot at which end the lip is rigid with the second skirt, the brake shoe urging means comprising a cam which is movable in the slot and has a profile which is complementary to the profile of the slot.

14. A mechanism as claimed in claim 13, wherein the brake shoe urging means comprises a knob having an outer skirt which surrounds the skirt of said other pulley, an inner skirt which is disposed between the skirt of said member rigid with the support means and a cylindrical portion of said member connected to the skirt of said member rigid with the support means, and an annular web interconnecting said inner and outer skirts and carrying said cam.

15. A mechanism as claimed in claim 14, wherein the braking device comprises a plurality of brake shoes and an equal number of cams.

16. A mechanism as claimed in claim 1, 7 or 12, wherein the support means is fixed to the drawing board along a first transversely extending edge of the board and the guide means comprise endless members and second pulleys which are disposed in the vicinity of a second transversely extending edge of the board, the endless members respectively extending around the second pulleys, two means for regulating the tension of the endless members being provided and each tension regulating means comprising a second shaft which carries the corresponding second pulley, a support unit fixed alongside said second transversely extending edge of the board and defining and oblong bore, the second shaft being mounted in the oblong bore which is elongated in a plane parallel to the plane of the board, each tension regulating means further comprising means for regulating the position of the second shaft in the oblong bore.

17. A mechanism as claimed in claim 16, wherein each second shaft has a screwthreaded end portion and a retaining head which is located at an opposed end of the second shaft and projects from the oblong bore for retaining the second shaft in the oblong bore, a clamping knob screwthreadedly engaged on the screwthreaded end portion, the corresponding second pulley being mounted on the second shaft by means of a rolling bearing having an inner ring and an outer ring, the knob being cooperative with said inner ring for clamping the inner ring against the support unit and thereby fixing the second shaft in the oblong bore.

18. A mechanism as claimed in claim 17, wherein the support unit comprises a cylinder in which the oblong bore is provided and a support member which comprises a tube in which the cylinder is fitted and an L-section portion which has two flanges fixed to the drawing board.

19. A mechanism as claimed in claim 1, 7 or 12, wherein the guide means comprise inextensible toothed belts.

* * * * *